US005471703A

United States Patent [19]

Niven

[11] Patent Number: 5,471,703

[45] Date of Patent: Dec. 5, 1995

[54] APPARATUS FOR APPLYING PAINT

[75] Inventor: Donald K. Niven, Orland Park, Ill.

[73] Assignee: Home E Z Products, Inc., Hazelcrest, Ill.

[21] Appl. No.: 243,255

[22] Filed: May 16, 1994

[51] Int. Cl.[6] ..... B05C 17/02

[52] U.S. Cl. ..... 15/230.11; 15/210.5; 15/230.13; 15/230; 15/19; 15/257.06; 492/13; 492/19; 492/24; 492/28; 492/48

[58] Field of Search ..... 15/147.1, 147.2, 15/210.5, 223–226, 230.11, 230.13, 230.14, 230.16, 230.17, 230.19, 231, 232, 257.05, 257.06; 492/13, 17, 19, 22, 24, 28, 29, 45, 48, 59

[56] References Cited

U.S. PATENT DOCUMENTS

| | | | |
|---|---|---|---|
| 509,537 | 11/1893 | Johnson | 492/24 |
| 1,291,131 | 1/1919 | Radel | 15/147.1 |
| 1,849,497 | 3/1932 | Mazer | 15/230.16 |
| 2,663,074 | 12/1953 | Schultheis | 492/48 |
| 2,972,765 | 2/1961 | Macy et al. | 15/257.06 |
| 3,452,383 | 7/1969 | Eichner | 15/147.1 |
| 4,047,260 | 9/1977 | Deutsch et al. | 15/147.2 |
| 4,536,910 | 8/1985 | Clark | 15/245.1 |
| 5,088,148 | 2/1992 | Hernandez | 15/147.1 |
| 5,206,979 | 5/1993 | Campbell | 15/230.11 |
| 5,343,587 | 9/1994 | Findley | 15/231 |

FOREIGN PATENT DOCUMENTS

| | | | |
|---|---|---|---|
| 1169134 | 9/1958 | France | 15/230.11 |
| 21507 | 2/1930 | Netherlands | 15/230.13 |
| 223287 | of 1924 | United Kingdom | 15/147.2 |

*Primary Examiner*—Mark Spisich
*Attorney, Agent, or Firm*—Greer, Burns & Crain, Ltd.

[57] ABSTRACT

Apparatus for applying paint to walls includes a paint roller, a rotating tube and a rag which is wrapped around and secured to the tube. The tube may be made of a flexible material, and has openings for securing the rag to the tube. A plurality of openings may be arranged around the circumference of the tube at both ends thereof. The apparatus may be used to create marble-like patterns on the wall, similar to that obtained by rag rolling or sponging paint on walls by hand.

7 Claims, 4 Drawing Sheets

APPARATUS FOR APPLYING PAINT

This invention relates to methods and apparatus for applying paint, and more particularly, to methods and apparatus for painting unique patterns on walls.

Walls, ceilings and the like may be painted using a conventional brush or roller. When a brush or roller is used properly, the paint is applied in a consistent manner, but without any pattern.

It is known that paint may be applied to a wall in pattern by putting the paint on a rag or a sponge and applying the paint to the wall with the rag or sponge. The patterns created using this technique are unique and interesting, and often have a marble-like appearance. However, this method of applying paint is time-consuming and messy. For these reasons, there is a need for methods and apparatus for applying paint to walls in unique patterns which are less time-consuming than hand application. There is also a need for methods and apparatus for applying paint to walls in unique patterns which are less messy than hand application.

Another problem with hand application of paint with rags or sponges is that it is difficult to make the pattern consistent. Also, the paint tends to run when it is applied by hand. Thus, there is also a need for methods and apparatus for applying paint patterns in more consistent patterns. There is also a need for methods and apparatus for applying paint patterns which are easier to apply.

Accordingly, one object of this invention is to provide new and improved methods and apparatus for applying paint which are less time-consuming than hand application.

Another object is to provide new and improved methods and apparatus for applying paint in unique patterns which are less messy than hand application.

Still another object is to provide new and improved methods and apparatus for applying paint patterns in more consistent patterns.

Yet another object is to provide new and improved methods and apparatus for applying paint patterns which are easier to apply.

SUMMARY OF THE INVENTION

In accordance with one aspect of this invention, apparatus for applying paint to walls includes a paint roller having a handle and a rotating tube. A rag is wrapped around and secured to the tube. The tube is preferably made of a flexible material, and has means for securing the rag to the tube. The securing means may be a plurality of openings arranged around the circumference of the tube at both ends thereof, or any other suitable structure.

The rag may be wrapped around and secured to the tube in any number of ways, to create many creative, unique patterns. Two rags may used, if desired, to create even more unique patterns. A board may be used when the paint is applied to the rag. Half of the board may be covered with plastic, while the other half is exposed. Paint is placed on the plastic covered half of the board with a spatula or the like, and spread. The paint is placed on the rag by rolling the rag on this surface. Then the paint covered rag roller is rolled over the exposed board to evenly spread the paint, and remove excess paint. When the rag is ready, the paint is rolled onto the wall. The paint is generally rolled on one stroke or pass at a time before the rag is re-filled with paint. The paint may be rolled onto the wall in a continuous line to create marble-like patterns, or the roller handle may be rotated to create unique circular patterns.

BRIEF DESCRIPTION OF THE DRAWINGS

The above mentioned and other features of an embodiment of the invention and the manner of obtaining them will become more apparent, and will be best understood by reference to the following description, taken in conjunction with the accompanying drawings, in which.

DETAILED DESCRIPTION

Figure 1:
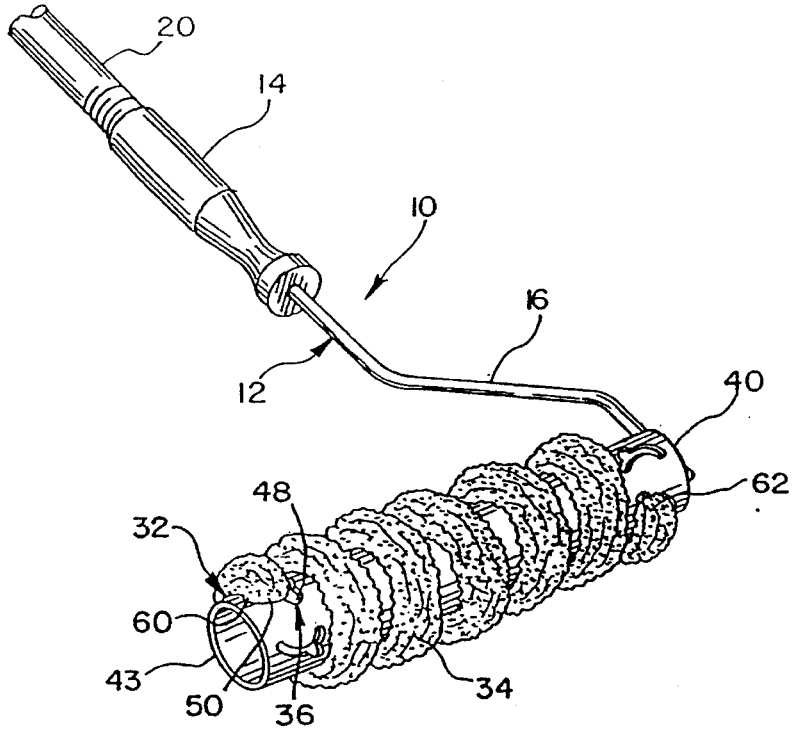
FIG. 1 is a perspective view of apparatus made in accordance with the invention.
Figure 2:
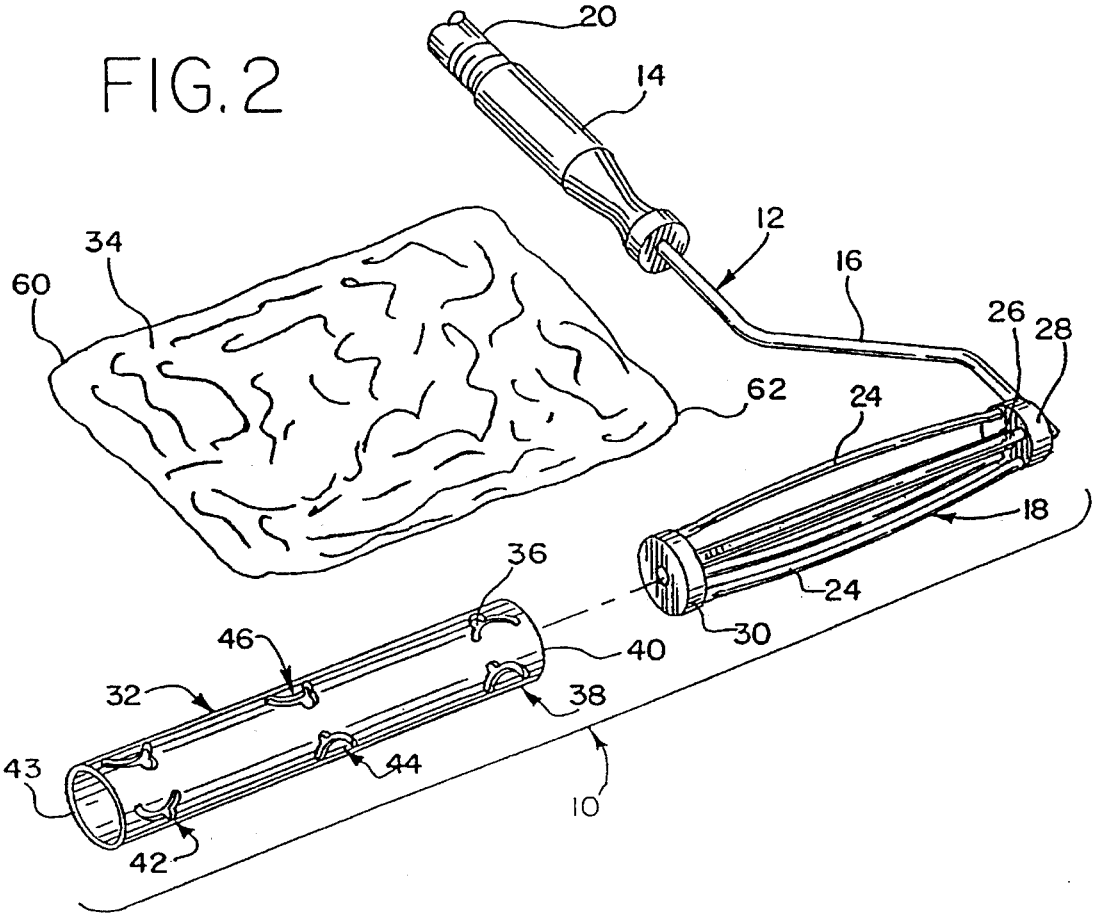
FIG. 2 is a perspective view of the apparatus of FIG. 1, shown disassembled.

As seen in FIGS. 1 and 2, apparatus 10 includes a commercially available paint roller 12 having a handle 14, an arm 16, and a rotating cage 18. An extended handle 20 may be used, if desired. The cage 18 includes a plurality of bars 24, and an axle 26. End pieces 28, 30 rotate around the axle 26, and secure the bars 24 in spaced relation around the axle 26.

A tube 32 fits snugly over the cage 18, and a rag 34 is wrapped around and secured to the tube 32. The rag may be wrapped as shown in FIG. 1, but it is preferably spread out more over the tube, so that substantially the entire tube is covered by the rag. The tube 32 may be made of any suitable solid, pliable extruded plastic material or the like. The tube 32 may be easily removed and replaced, as with conventional paint rollers. The rag 34 may be any suitable color-fast cloth, such as cotton or the like.

The tube 32 includes suitable structure for securing the rag 34 in place. In FIGS. 1 and 2, this is accomplished with a plurality of openings 36 in the tube 32. A first set 38 of openings 36 surround the tube 32 at an end 40, a second set 42 of openings 36 surround the tube 32 at the other end 43, and third and fourth sets of openings 44, 46 surround the tube 32 at the center.

Figure 3:
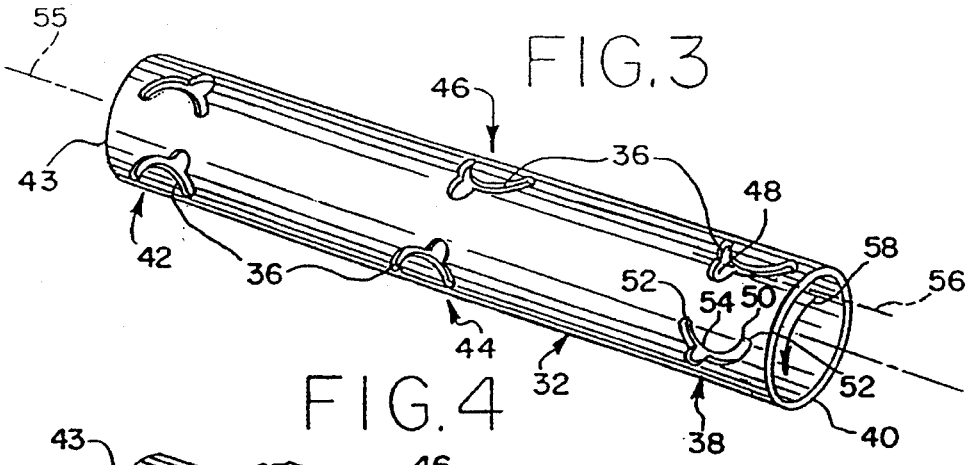
FIG. 3 is a perspective view of the tube used in the apparatus of FIG. 1.
Figure 4:
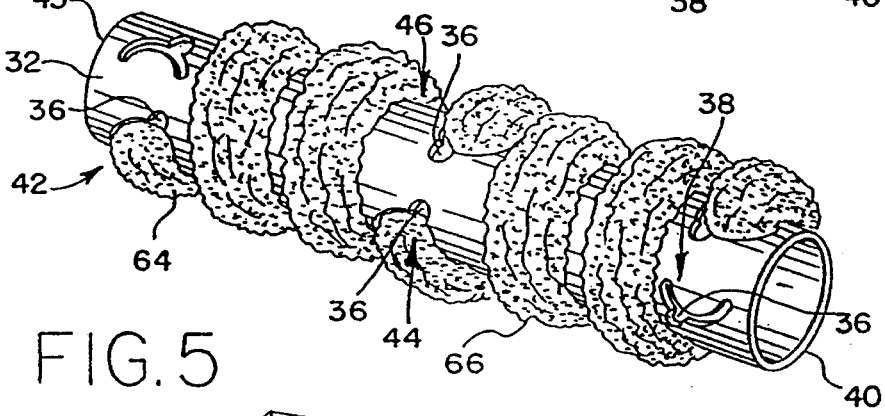
FIG. 4 is a perspective view of an alternate embodiment of the apparatus of FIG. 1, showing two rags secured to the tube.
Figure 9:
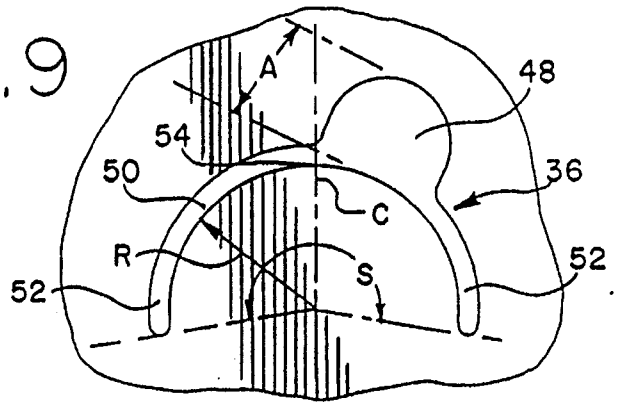
FIG. 9 is an enlarged view of an opening in the tube of FIG. 3.

The openings 36 may take many suitable forms. For example, FIGS. 3 and 9 show a suitable form for the openings 36 in which each opening 36 includes a round portion 48 and a U-shaped hook 50. The round portion 48 may be a hole about 3/16 inches in radius, and the U hook 50 may be a semi-circular or U-shaped slot in the circumference of the tube 32 having a width of about 1/16 inch, a radius R of about 7/16 inch, and an angular span S of about 200°. The distance A between the outermost surface of the round portion and the inside surface of the hook 50 may be about 5/16 inch.

The U hooks 50 each have a pair of legs 52 which flank a center section 54. The U hooks 50 are preferably oriented so that the legs 52 are generally aligned perpendicular to the axial direction of the tube 32, with a tangent 56 of the center 54 aligned in the axial direction of the tube 32. The round portion 48 may be offset from the center C of the center section 54.

Figure 8:
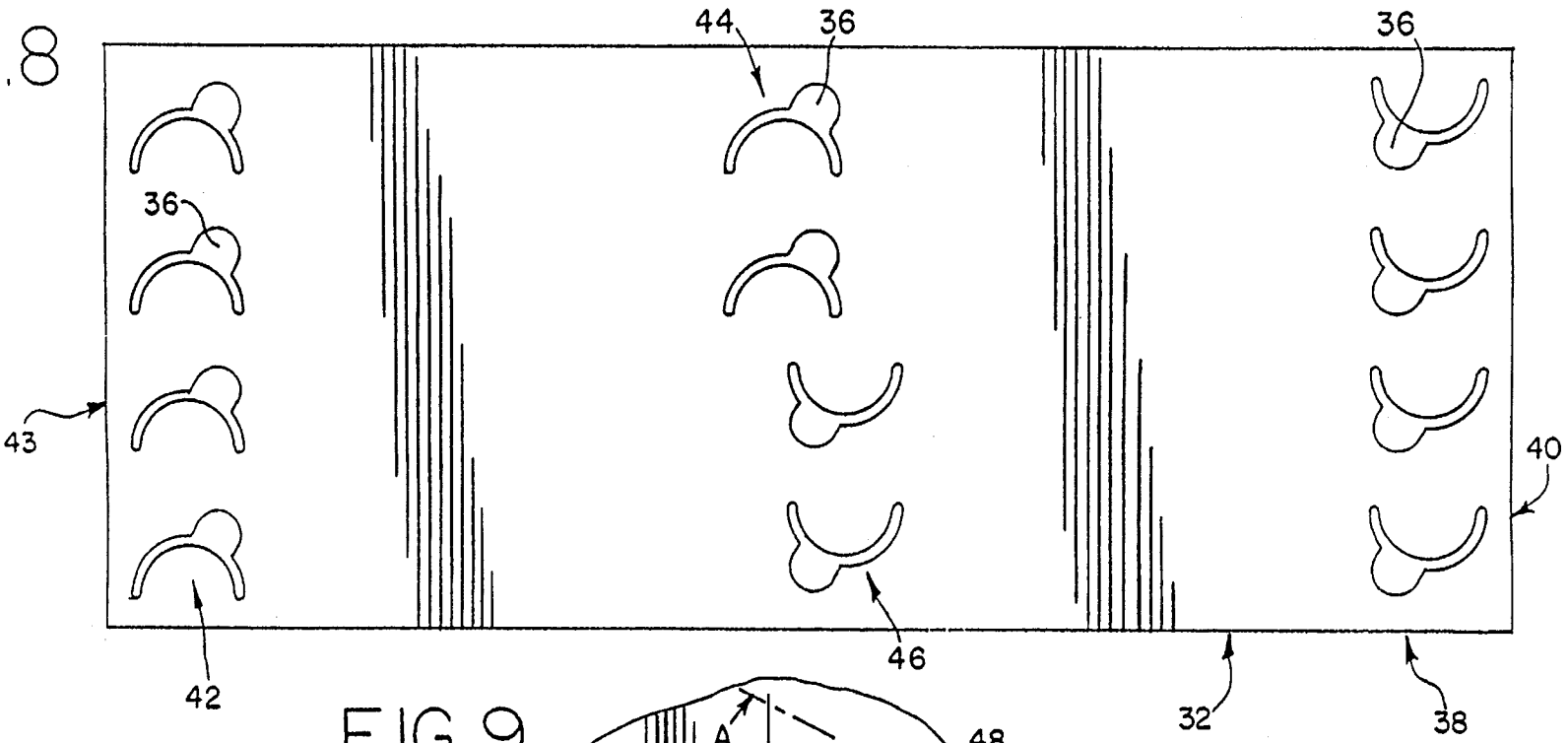
FIG. 8 is a plan view of the tube of FIG. 3, as it is die-cut.

The U hooks 50 in the sets of openings 38, 42, 44 and 46 are preferably oriented as shown in FIGS. 3 and 8. When viewed from the end 40 of the tube 32, the legs 52 of the U hooks in the set of openings 38 are oriented perpendicular to a tube axis 55 in the direction of the arrow 58, while the legs in the U hooks in the set of openings 42 are oriented in the direction opposite to the arrow 58. The legs in the set of openings 46 are oriented in the direction of the arrow 58, while the legs in the set of openings 44 are oriented in the opposite direction.

The rag 34 may be a commonly available four corner rag. A first corner 60 may be easily inserted through a selected round portion 48 and spread into the associated U hook 50, as seen in FIG. 1. In this manner, the corner 60 is secured to the tube 32. A small knot may be tied in the corner 60, if desired, to further insure that the corner 60 is securely fixed in the opening 36.

If a single rag is used, as in FIG. 1, the rag is wrapped around the tube 32 after the corner 60 is secured to the tube 32. The rag may be twisted in any desired manner. A second end 62 of the rag 34 is secured to a selected opening 36 in the end 40 of the tube 32. The openings 36 in the tube 32 are oriented so that when the corner 60 is spread around the opening 36, as in FIG. 1, the rag covers the U hook 50 to which it is secured. Moreover, the orientation of the U hooks at the end 40 is opposite to that of the U hooks at the end 43 so that when the rag 34 is wrapped around the tube 32 and secured to the end 43, it covers the selected U hook at that end, as well.

Figure 5:
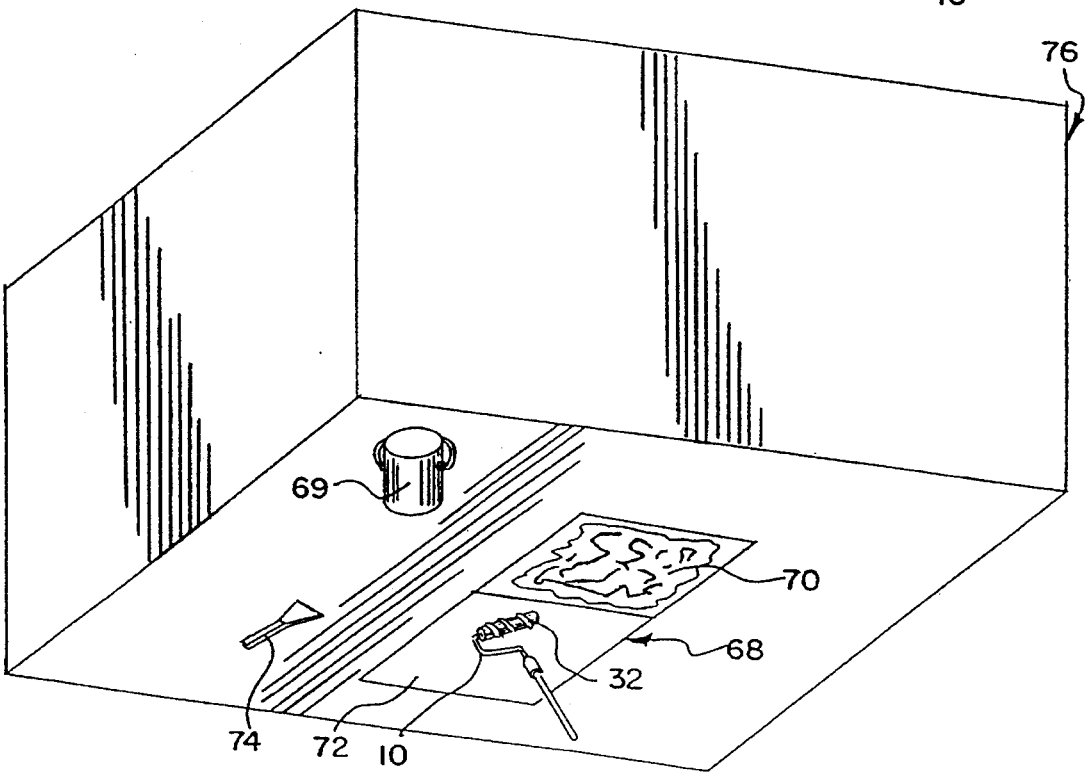
FIG. 5 is a perspective view of the apparatus of FIG. 1 in the environment in which it is used.

Two rags 64, 66 may be secured to the tube 32 if desired, as shown in FIG. 5. One end of the rag 64 is secured to an opening in the set 42, and another end of the rag 64 is secured to an opening in the set 46. One end of the rag 66 is secured to an opening in the set 44, and another end of the rag 66 is secured to an opening in the set 38. The orientation of the sets of openings 38, 42, 44, and 46 is such that the ends of the rags 64, 66 cover the U hook portions of the openings 36 to which they are attached.

The apparatus 10 is shown in its intended environment in FIG. 5. A board 68 is provided for applying paint from a can 69 to the rag 34. The board 68 is typically cardboard. A first half of the board 68 is covered with plastic 70, while another half 72 is exposed.

In use, a wall 76 is prepared for painting in a conventional manner. If the base wall color is changed, for example, the wall 76 should first be painted in a solid color. If not done already, the ceiling and adjoining walls should be taped off.

The wall 76 may be painted with one or more colors. Good results have been obtained with two color combinations, excluding the base wall color. While any type of paint may be used, good results have been obtained with semi-gloss latex paint. The lightest color is preferably applied first, with the darkest color applied last. The approximate coverage for one quart of semi-gloss latex paint is about 400–500 square feet.

The plastic cover 70 is placed on the end of the cardboard 68, and the cardboard 68 is placed on a protected floor area.

The tube 32 is placed on the roller cage 18, and one or two rags are chosen, depending on the final effect which is desired. A selected rag corner is pushed through a selected opening, and spread around the circle hook. If one rag is used, the rag is snugly wrapped around the tube to the opposite end, and then backed off to the desired opening, where the rag is secured.

If two rags are used, the first rag is secured to one end of the tube, wrapped around the tube and secured to one of the center tube openings. The second rag is then secured from the opposite end of the tube to the tube center.

Starting with the lightest color paint, about five scoops of paint are applied to the plastic 70 with a spatula 74. The paint is spread evenly over a portion of the plastic surface.

Taking the apparatus 10 by the handle 14 or extension 20, the tube 32 is then rolled over the paint five or six times. Then, the tube is rolled onto the uncovered half of the board 68 perhaps three times, to remove excess paint from the rag. The tube 32 now has enough paint to apply one complete pattern from ceiling to floor.

The roller may be replenished with paint after each ceiling to floor pattern is applied. About two scoops of paint are usually placed on the plastic surface about every third pass. This process is continued until the entire wall or room is completed.

Figure 7:
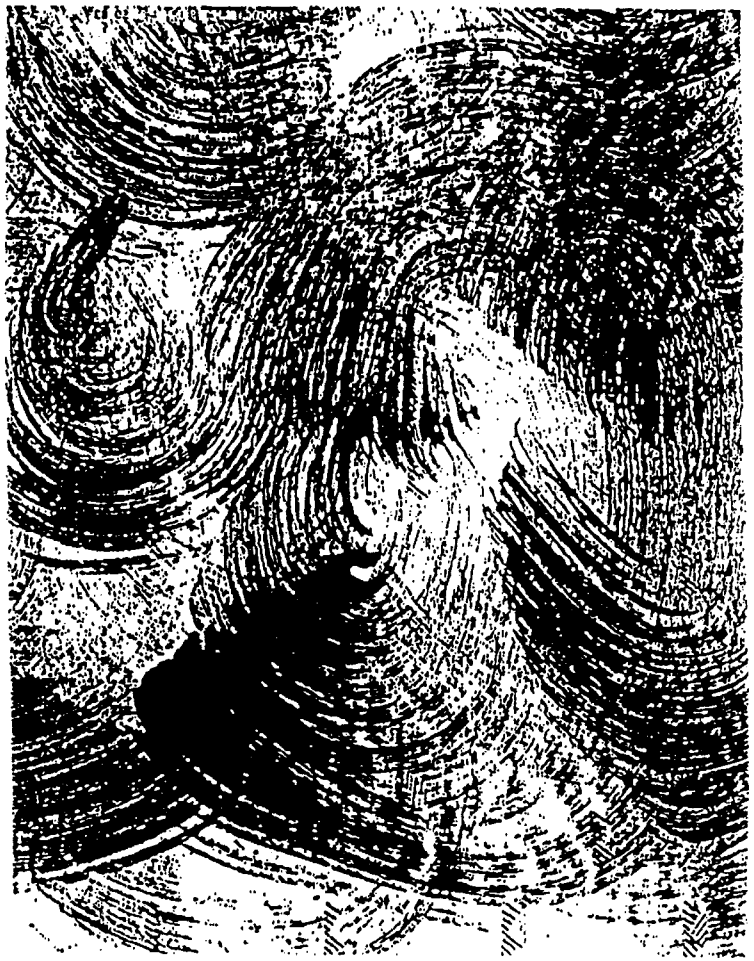
FIG. 7 is another pattern made with the apparatus of FIG. 1.
Figure 6:
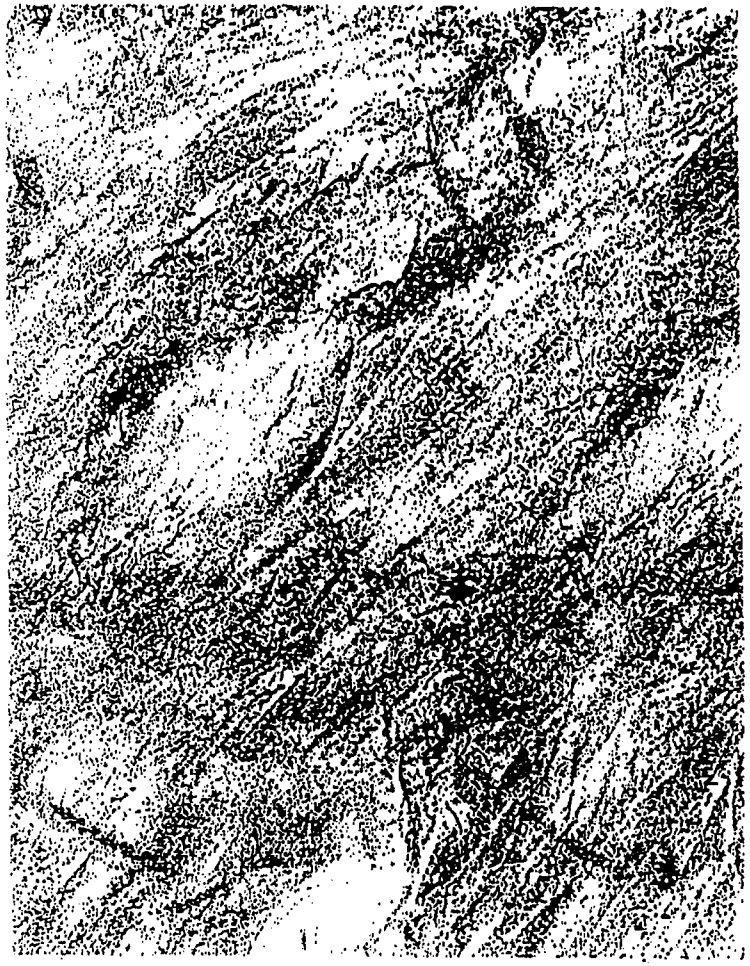
FIG. 6 is a pattern made with the apparatus of FIG. 1.

An almost infinite number of patterns can be obtained using this technique, including marble-like patterns. One pattern is shown in FIG. 6. The pattern shown in FIG. 6 was made by rolling the paint on in a single pass. If desired, the roller can be twisted on the wall 76 to create other different and unique patterns, such as that shown in FIG. 7.

The advantages of this invention are now apparent. The time required to paint using this technique is reduced substantially, by as much as 80 percent less than the time required for hand application. The paint is applied in unique patterns with very little mess, and more consistent patterns. In addition, the paint is easier to apply.

While the principles of the invention have been described above in connection with specific apparatus and applications, it is to be understood that this description is made only by way of example, and not as a limitation on the scope of the invention.

I claim:

1. Apparatus for applying paint comprising a paint roller having a handle and a rotatable cage operatively connected thereto, a cylindrical tube operatively connected to and about said cage so as to be rotatable therewith, said tube having an axis extending along the length thereof, first and second open ends and an annular wall between said first and second open ends, a first rag, and means for securing said first rag to said tube, said securing means including at least one opening in said tube wall at each end of said tube, a portion of said rag being located in said at least one opening at each end of said tube wall.

2. The apparatus of claim 1 wherein said securing means includes a plurality of openings at each end of said tube wall.

3. The apparatus of claim 1 wherein said tube wall is flexible adjacent said openings and said openings each include a U hook portion in the circumference of said tube wall.

4. The apparatus of claim 3 wherein said U hook portions each include a pair of legs flanked by a center section, said U hook portions being oriented so that said legs are generally aligned perpendicular to the tube axis.

5. The apparatus of claim wherein said openings having said U hook portions each also include a round portion which intersects a respective U hook portion.

6. The apparatus of claim wherein said U hook portions at said first wall end having a pair of legs flanked by a center section oriented in the opposite direction perpendicular to said tube axis, said U hook portions at said second wall end having a pair of legs flanked by a center section oriented in the opposite direction perpendicular to said tube axis.

7. The apparatus of claim 1 comprising a second rag and means for securing said second rag to said tube, said tube having at least one opening intermediate the ends of said wall, for securement of said first and second rags.

* * * * *